US006997774B2

(12) United States Patent
Kaneko et al.

(10) Patent No.: US 6,997,774 B2
(45) **Date of Patent: *Feb. 14, 2006**

(54) STEERING DEVICE FOR TOY

(75) Inventors: Yoshinobu Kaneko, Tokyo (JP); Yousuke Yoneda, Tokyo (JP); Yoshio Suimon, Tokyo (JP)

(73) Assignee: Tomy Company, Ltd., Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 10/806,216

(22) Filed: Mar. 23, 2004

(65) Prior Publication Data

US 2004/0198172 A1 Oct. 7, 2004

Related U.S. Application Data

(63) Continuation of application No. 10/056,090, filed on Jan. 28, 2002.

(51) Int. Cl.
*A63H 17/36* (2006.01)

(52) U.S. Cl. ..... 446/466; 446/468

(58) Field of Classification Search ..... 446/468, 446/466, 454, 460

See application file for complete search history.

(56) References Cited

U.S. PATENT DOCUMENTS

| | | | |
|---|---|---|---|
| 3,083,499 | A | 4/1963 | Baltazor |
| 3,774,340 | A | 11/1973 | Barlow et al. |
| 4,034,504 | A | 7/1977 | Sudo |
| 4,163,341 | A | 8/1979 | Jones et al. |
| 4,171,592 | A | 10/1979 | Saitoh |
| 4,197,672 | A | 4/1980 | Mabuchi et al. |
| 4,471,566 | A | 9/1984 | Ishimoto |
| 4,571,213 | A | 2/1986 | Ishimoto |
| 4,743,214 | A | 5/1988 | Tai-Cheng |
| 4,764,150 | A | 8/1988 | Uchino |
| 4,816,795 | A | 3/1989 | Suto |
| 4,881,917 | A | 11/1989 | Suzuki et al. |
| 4,882,942 | A | 11/1989 | Hamilton |
| 4,898,562 | A | 2/1990 | Ishimoto |
| 5,281,184 | A | 1/1994 | Suimon |

(Continued)

FOREIGN PATENT DOCUMENTS

| | | |
|---|---|---|
| EP | 0307659 | 3/1989 |

(Continued)

OTHER PUBLICATIONS

U.S. Appl. No. 10/056,090, filed Jan. 28, 2002, Kaneko et al., Tomy Co., Ltd.

(Continued)

*Primary Examiner*—Boyer D. Ashley
*Assistant Examiner*—J Williams
(74) *Attorney, Agent, or Firm*—Staas & Halsey LLP

(57) ABSTRACT

A steering device for a toy including: right and left turning members for turning right and left steering wheels in clockwise and counterclockwise directions around predetermined shafts; and a connecting member for connecting and forming a turning pair with each turning member. The right and left turning members are turned around each predetermined shaft by moving the connecting member in right and left directions so as to change each direction of the steering wheels. One of a coil and a magnetic body is provided on the connecting member, the other of the coil and the magnetic body is fixed to a fixing portion of the toy, and the coil and the magnetic body come close to and go away from each other by moving the connecting member. The connecting member takes at least two steering positions by controlling a current to be carried to the coil with a coil current carrying unit.

41 Claims, 9 Drawing Sheets

U.S. PATENT DOCUMENTS

| | | | |
|---|---|---|---|
| 5,338,247 | A | 8/1994 | Miles |
| 5,775,972 | A | 7/1998 | Siu |
| 5,851,134 | A | 12/1998 | Chiu |
| 6,350,173 | B1 | 2/2002 | Tsang |
| 6,827,627 | B1 | 12/2004 | Tsang |
| 2002/0094752 | A1 | 7/2002 | Kaneko et al. |
| 2002/0123296 | A1 | 9/2002 | Tsang |
| 2003/0143921 | A1 | 7/2003 | Yoneda |

FOREIGN PATENT DOCUMENTS

| | | | |
|---|---|---|---|
| GB | 1095490 | | 12/1967 |
| GB | 2112655 | A | 7/1983 |
| GB | 2187108 | | 9/1987 |
| GB | 2201549 | | 9/1988 |
| GB | 2275206 | | 6/1994 |
| JP | 35-7175 | | 6/1960 |
| JP | 61-2884 | | 1/1986 |
| JP | 64-28690 | | 2/1989 |
| JP | 3111077 | | 5/1991 |
| JP | 7-299255 | * | 11/1995 |
| JP | 3030650 | | 8/1996 |
| JP | 10-085463 | | 4/1998 |
| JP | 11-057235 | | 3/1999 |
| JP | 2001-353379 | | 12/2001 |

OTHER PUBLICATIONS

Combined Search and Examination Report in Counterpart British Appln. No. 0205521.8 Abstract Aug. 20-21, 2002.

Public Protest filed in U.S. Appl. No. 10/056,090.

Japanese Office Action dated Nov. 18, 2004 in Application No. 2000-361533, for which priority was claimed in the original declaration.

Japanese Office Action dated Nov. 18, 2004 in Application No. 2004-215829.

* cited by examiner

STEERING DEVICE FOR TOY

CROSS-REFERENCE TO RELATED APPLICATIONS

This application is a continuation application of Ser. No. 10/056,090 filed Jan. 28, 2002, entitled "STEERING DEVICE FOR RUNNING TOY AND RUNNING TOY", now pending and allowed.

BACKGROUND OF THE INVENTION

1. Field of the Invention

The present invention relates to a steering device for a toy and a running toy. In particular, the present invention relates to a steering device for a toy, which steers a toy by using an electromagnetic force, and a running toy comprising the steering device, such as a vehicle toy or the like.

2. Description of the Related Art

According to an earlier development, a vehicle toy using a mechanism for swinging a front wheel shaft by an electromagnetic force, has been known (Japanese Patent Application Publication No. Tokukai-Hei 11-57235). A steering device for the vehicle toy is one for steering by using a swinging motor. The swinging motor comprises a rotor provided swingably on the front wheel shaft which is provided swingably, by forming unitedly with the front wheel shaft, and a coil for swinging the rotor. The steering device for a toy is constructed so that the direction of the front wheel shaft is changed by controlling the current to be carried to the coil in three states which are "OFF", a forward direction and a reverse direction, in order to swing the swinging motor in a desired direction.

The cylindrical rotor is attached to the front wheel shaft. An upper end of the rotor is supported by an upper chassis. The rotor is inserted rotatably along an inner peripheral portion of a lower chassis around a rotor shaft provided vertically. One position of a peripheral portion of the rotor, which is normal to the front wheel shaft, is the N pole. The other position opposite to the one position is the S pole. On the other hand, a coil for forming the swinging motor is wound around an outer peripheral portion of a cylinder formed by the lower chassis and the upper chassis. The direction of the front wheel shaft is changed by controlling the current to be carried to the coil. A yoke is provided so as to cover an upper surface and both side surfaces, of the middle portion of the coil. When the current is not carried to the coil, the front wheel shaft keeps in a neutral position (position for directing the wheels to a straight direction) by an attractive force generated between the rotor and the yoke.

However, in the above steering device, because the front wheels are provided on both side portions of one front wheel shaft so as to swing the one front wheel shaft, the vehicle toy runs along a curved line unstably by swinging the whole front wheel shaft and the front wheels largely on a winding road or the like, for example, a road in which a right (left) curve suddenly turns to a left (right) curve. In order to solve the above problem, the front wheel shafts may be provided on right and left sides independently of each other to swing each front wheel shaft in right and left directions around a shaft provided near each front wheel. When this steering device is used, two parts having a rotor, a coil and a yoke each must be provided on right and left sides. A coil must be wound around the rotor. Further, a coil must be wound in a slightly wider range than a projected width of the rotor so as to sufficiently cause an electromagnetic force for the rotor.

As a result, there is a problem that the structure of the steering device is complicated.

SUMMARY OF THE INVENTION

In order to solve the above-described problems, an object of the present invention is to provide a steering device for a toy and a vehicle toy, which have simple structures and which provide a stable running along a curved line.

That is, in accordance with the first aspect of the present invention, a steering device for a toy, comprises: right and left turning members for turning right and left steering wheels in clockwise and counterclockwise directions around each predetermined shaft; and a connecting member for connecting the right and left turning members with each other and for forming a turning pair with each turning member; wherein the right and left turning members are turned around each predetermined shaft by moving the connecting member in right and left directions so as to change each direction of the steering wheels; one of a coil and a magnetic body is provided on the connecting member, the other of the coil and the magnetic body is fixed to a fixing portion, and the coil and the magnetic body come close to and go away from each other by moving the connecting member; and the connecting member takes at least two steering positions by controlling a current to be carried to the coil with a coil current carrying unit. In this specification, the term "magnetic body" includes a permanent magnet and material which is magnetized in a magnetic field, that is, which has magnetism.

The arrangement of "coil" and "magnetic body" will be explained in this case. The "permanent magnet" may be provided on the connecting member, and the "coil" may be provided on the fixing portion which is provided separate from the connecting member. To the contrary, the "coil" may be provided on the connecting member, and the "permanent magnet" may be provided on the fixing portion which is provided separate from the connecting member. The term "controlling a current" includes a control that a current is cut off, the direction of the current is changed, and the like.

According to the steering device for a toy, because the connecting member takes at least two steering positions by controlling the current to be carried to the coil with a coil current carrying unit, the right and left steering wheels can be directed to at least two directions.

In the above-described steering device for a toy, preferably, the permanent magnet is provided so as to direct two poles of the permanent magnet to right and left directions, and the coil is provided so as to face an edge portion of the coil to one of the poles.

In this case, in order to "direct two poles of the permanent magnet to right and left directions", the permanent magnet is disposed so as to arrange the poles (N pole and S pole) of one permanent magnet in each of right and left positions. When two permanent magnets are used, one pole (N pole or S pole) of one permanent magnet is arranged on a left side and the other pole (S pole or N pole) of the other permanent magnet is arranged on a right side. Alternatively, the same poles (N pole or S pole) of two permanent magnets are arranged on right and left sides.

In this case, the controlling of the current to be carried to the coil, may be carried out so as to actuate the right and left coils simultaneously to move the connecting member by both an attractive force and a repulsive force which are generated between the right and left coils and the permanent magnet. Further, the controlling may be carried out so as to actuate one of the right and left coils to move the connecting member by an attractive force or a repulsive force which is generated between the actuated one of the right and left coils and the permanent magnet.

According to the steering device for a toy, because the connecting member is moved to one magnetic body by controlling the current to be carried to the coil, the steering can be carried out.

The connecting member may comprise a spring for keeping the connecting member in a neutral position in which the connecting member is not biased toward a right direction nor a left direction when the current is not carried to the coil; and the connecting member may take three steering positions.

According to the steering device for toy, which has such a structure, when the current is not carried to the coil, the connecting member takes the neutral position by the spring. When the current is carried to the coil, the connecting member is moved in a direction corresponding to a direction of the current.

In accordance with the second aspect of the present invention, a steering device for a toy, comprises: right and left turning members for turning right and left steering wheels in clockwise and counterclockwise directions around each predetermined vertical shaft; a connecting member for connecting the right and left turning members with each other and for forming a turning pair with each turning member; an electromagnetic force applying member for applying an electromagnetic force for moving the connecting member in right and left directions; and a current carrying control unit for controlling an operation of the electromagnetic force applying member.

In accordance with the third aspect of the present invention, a running toy comprises: a steering device for a toy, comprising: right and left turning members for turning right and left steering wheels in clockwise and counterclockwise directions around each predetermined shaft; and a connecting member for connecting the right and left turning members with each other and for forming a turning pair with each turning member; wherein the right and left turning members are turned around each predetermined shaft by moving the connecting member in right and left directions so as to change each direction of the steering wheels; one of a coil and a magnetic body is provided on the connecting member, the other of the coil and the magnetic body is fixed to a fixing portion, and the coil and the magnetic body come close to and go away from each other by moving the connecting member; and the connecting member takes at least two steering positions by controlling a current to be carried to the coil with a coil current carrying control unit.

Preferably, the running toy further comprises a suspension for moving the right and left turning members in upper and lower directions in a predetermined range; the suspension comprising a biasing member which is supported in a middle of a width direction of the running toy so that right and left edge portions of the biasing member are elastically deformable in upper and lower directions and which extends on the right and left turning members; wherein the turning members are pressed with the right and left edge portions by a biasing force which is caused by elastically deforming the biasing member, so that the right and left steering wheels are in contact with a ground.

The running toy may further comprise: a suspension for the running toy comprising two wheel shafts for attaching right and left wheels; the suspension comprising a biasing member which is elastically deformable in upper and lower directions and is in contact with the wheel shafts in a middle of a width direction of the running toy; wherein the wheel shafts are movable in the upper and lower directions in a predetermined range; the wheel shafts are constructed so as to perform a seesaw motion by taking a contact point with the biasing member as a fulcrum; and the turning members are pressed at the contact point by a biasing force which is caused by elastically deforming the biasing member, so that the right and left steering wheels are in contact with a ground.

The running toy may further comprise: a suspension for the running toy comprising two wheel shafts for attaching right and left wheels; the suspension comprising a biasing member which extends on the wheel shafts and is supported in a middle of a width direction of the running toy so that right and left edge portions of the biasing member are elastically deformable in upper and lower directions; wherein the wheel shafts are movable in the upper and lower directions in a predetermined range; and the wheel shafts are pressed with the right and left edge portions by a biasing force of the biasing member so that the right and left steering wheels are in contact with a ground.

In accordance with the fourth aspect of the present invention, a running toy comprises: a steering device comprising: right and left turning members for turning right and left steering wheels in clockwise and counterclockwise directions around each predetermined vertical shaft; a connecting member for connecting the right and left turning members with each other and for forming a turning pair with each turning member; an electromagnetic force applying member for applying an electromagnetic force for moving the connecting member in right and left directions; and a current carrying control unit for controlling a current to be carried to the electromagnetic force applying member, so that the connecting member takes at least two steering positions; and a suspension device for pressing the right and left turning members which are movable in upper and lower directions in a predetermined range, so that the right and left steering wheels are in contact with a ground.

According to the running toy, it is possible that, for example, a vehicle toy runs along a straight line, or turns to either the right or the left, by using a remote control.

BRIEF DESCRIPTION OF THE DRAWINGS

The present invention will become more fully understood from the detailed description given hereinbelow and the accompanying drawings which are given by way of illustration only, and thus are not intended as a definition of the limits of the present invention, and wherein.

EMBODIMENTS OF THE INVENTION

Figure 1:
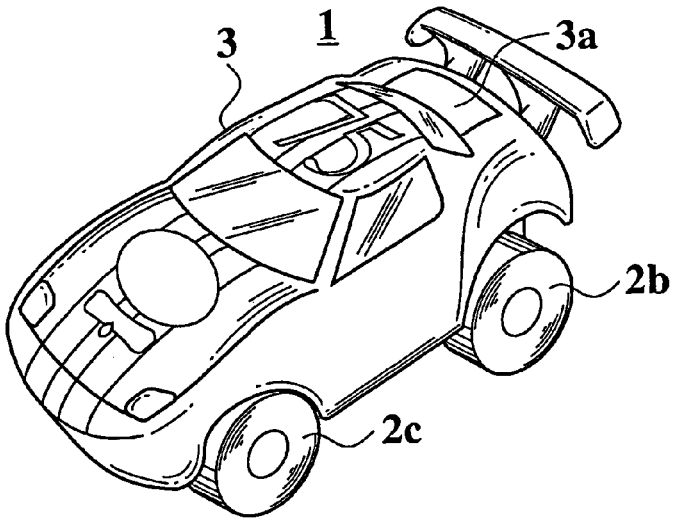
FIG. 1 is a perspective view showing a vehicle toy according to one embodiment of the present invention.
Figure 2:
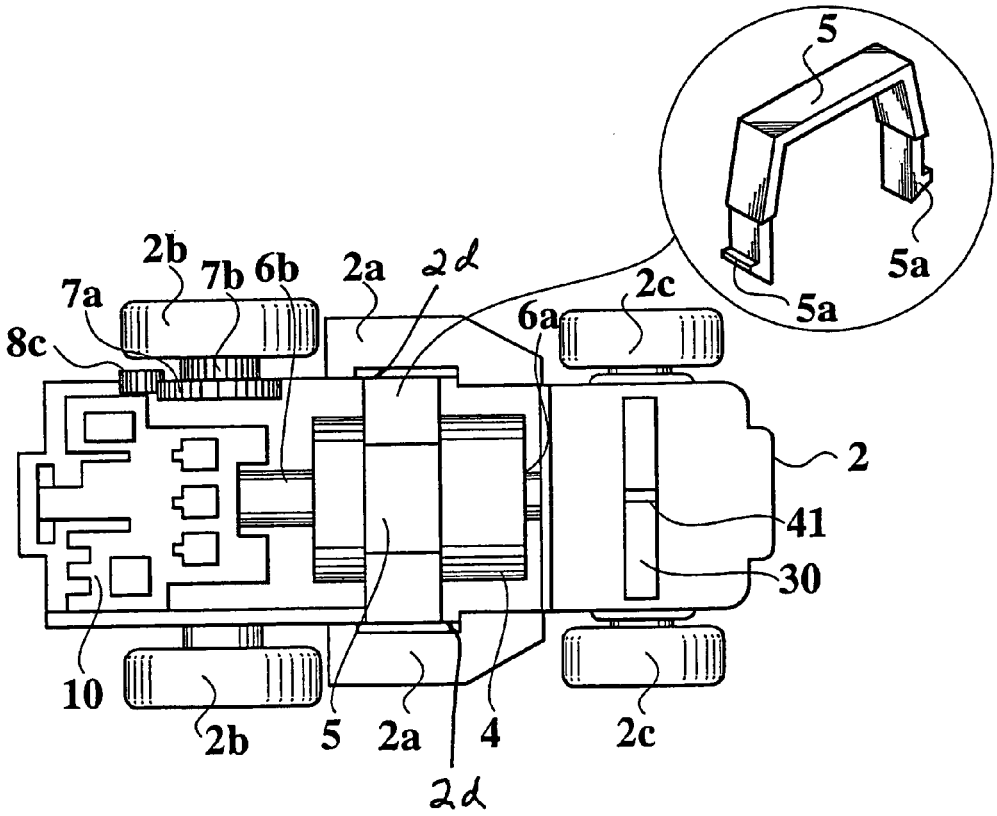
FIG. 2 is a plan view showing a chassis of the vehicle toy shown in FIG. 1.

FIG. 1 is a perspective view of a racing vehicle (racing car) toy to which a steering device for a toy according to an embodiment of the present invention is applied. A housing of the vehicle toy 1 includes a chassis (base body) 2 and a body 3 which are shown in FIGS. 1 and 2. The chassis 2 and the body 3 are formed out of plastic or the like. A front portion and side portions, of the body 3 have some elasticity. The chassis 2 and the body 3 are not limited to the following structures and the like. A recess portion or a hole portion (engaging portion) is provided on an inner side of the front portion and each inner side of the side portions. The body 3 is fixed to the chassis 2 by elastically engaging a projection portion 2*a* of the chassis 2 with the recess portion or the hole portion. The vehicle toy 1 comprises an antenna (not shown in the figure) for receiving a control signal outputted from a controller which is not shown in the figure.

FIG. 2 is a plan view showing the chassis 2. A chargeable battery (for example, Ni—Cd battery) 4 is set to a central portion of the chassis 2 longitudinally (so as to direct it to a running direction of the vehicle toy). The battery is not limited to this. The battery 4 is attached to a battery containing part by an attachment member 5. The attachment member 5 is formed out of plastic or the like and is an inverted U-shape so as to hold a body part of the battery 4 from the upside. Both free end portions of the attachment member 5 have some elasticity and can be deformed in two directions of coming close to and going away from each other. Each engaging pawl (engaging portion) 5*a* and 5*a* is provided on the outer side of each free end portion. The battery 4 is fixed by engaging the engaging pawls 5*a* and 5*a* with each edge (engaging portion) of two hole portions 2*d* of the chassis 2. Two conductive pieces 6*a* and 6*b* which can be electrically connected to the positive electrode and the negative electrode, of the battery 4 are provided on the front side and the rear side of the battery containing part. The conductive pieces 6*a* and 6*b* are partially exposed to a lower surface side of the chassis 2. The exposed portions are not shown in the figure. The battery 4 can be charged by using the conductive pieces 6*a* and 6*b* which are partially exposed.

Figure 3:
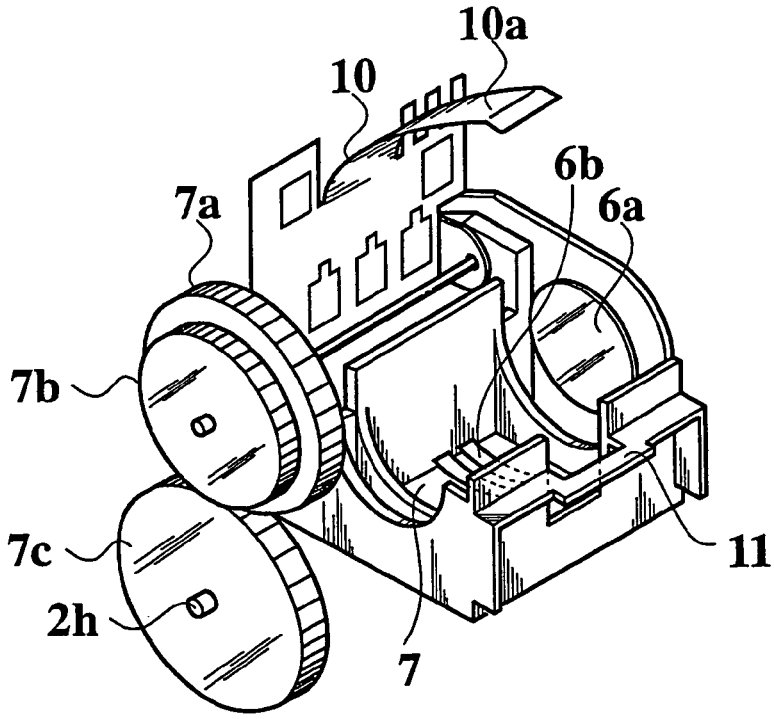
FIG. 3 is a perspective view showing a motor containing part of the vehicle toy shown in FIG. 1.
Figure 4:
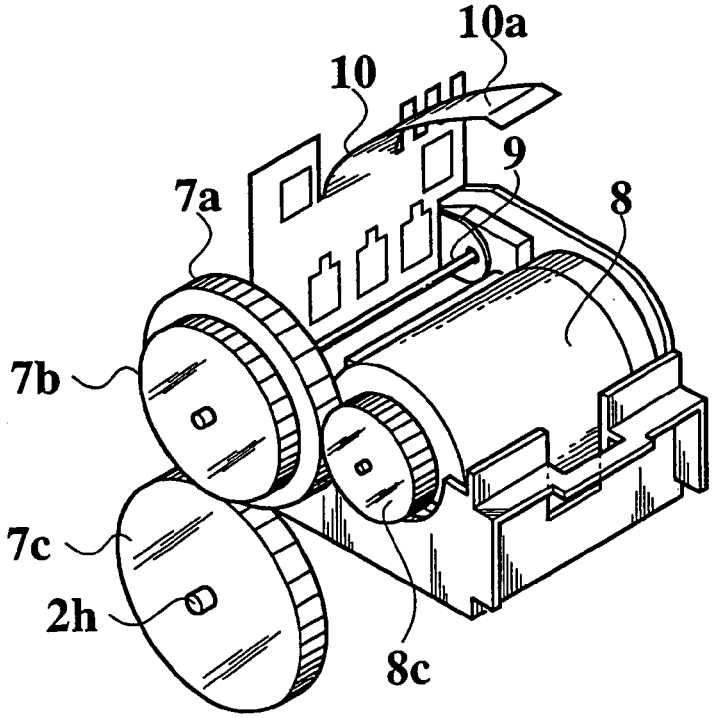
FIG. 4 is a perspective view showing the motor containing part in a state of containing a motor.
Figure 5:
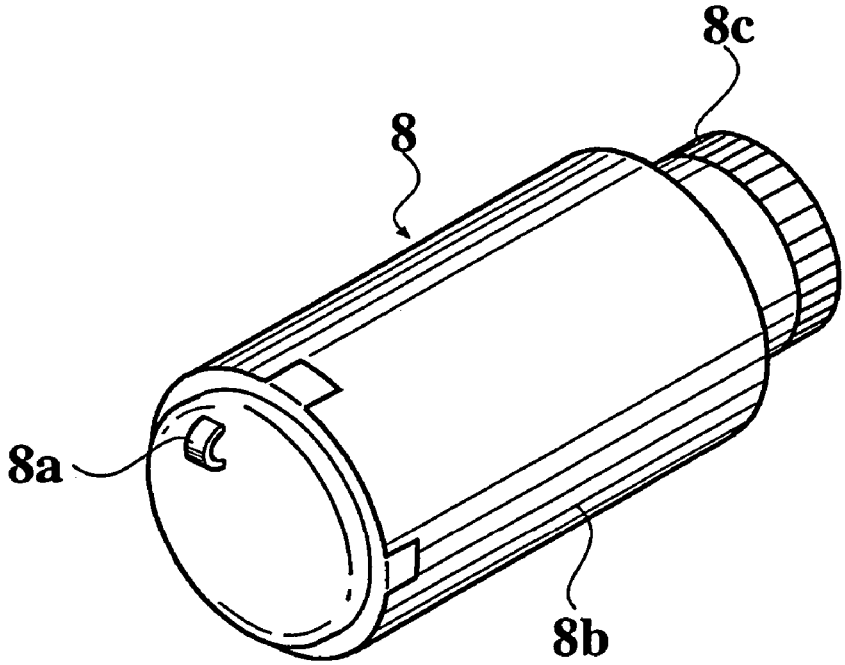
FIG. 5 is a perspective view showing an example of a motor used in the vehicle toy shown in FIG. 1.

A motor containing part 7 is provided on a rear portion of the chassis 2 as shown in FIG. 3. As shown in FIG. 4, a motor 8 is set to the motor containing part 7 in a state of arranging it transversally (so as to direct it to a horizontal direction which is normal to the running direction of the vehicle toy). The motor 8 is a DC motor. As shown in FIG. 5, a conductive piece 8*a* is projected from a tail portion of the motor 8. The conductive piece 8*a* constitutes a negative terminal and is electrically connected to the negative electrode of the battery 4. On the other hand, a body part 8*b* of the motor 8 constitutes a positive terminal and is electrically connected to the positive electrode of the battery 4.

Hereinafter, the motor containing part 7 will be explained. The motor containing part is not limited to the following structure. As shown in FIG. 3, one edge of the conductive piece 6*a* which is electrically connected to the negative electrode of the battery 4, is extended to a right side wall of the motor containing part 7. On the other hand, one edge of the conductive piece 6*b* which is electrically connected to the positive electrode of the battery 4, is extended to the bottom of the motor containing part 7. When the motor 8 is set to the motor containing part 7 as shown in FIG. 4, the negative terminal 8*a* projecting from the tail portion of the motor 8 is electrically connected to the conductive piece 6*a* automatically. Further, the positive terminal 8*b* provided on the body part of the motor 8 is electrically connected to the conductive piece 6*b* automatically. A gear 8*c* is fixed to a motor shaft of the motor 8 so as to transmit the rotation of the motor 8 to the gear 8*c*.

A gear 7*a* and a gear 7*b* are set near the left side wall of the motor containing part 7 as shown in FIGS. 2 to 4. These gears 7*a* and 7*b* are unitedly formed out of plastic or the like, and are constructed so as to idle themselves around a transversal shaft (rotational shaft) 9. The gear 7*b* is engaged with a gear 7*c* which is fixedly provided on a rear wheel shaft 2*h* for the rear wheels 2*b* and 2*b*. As a result, the rear wheels 2*b* and 2*b* are rotated by transmitting the power of the motor from the gear 7*a* to the gears 7*b* and 7*c* in order.

Figure 6:
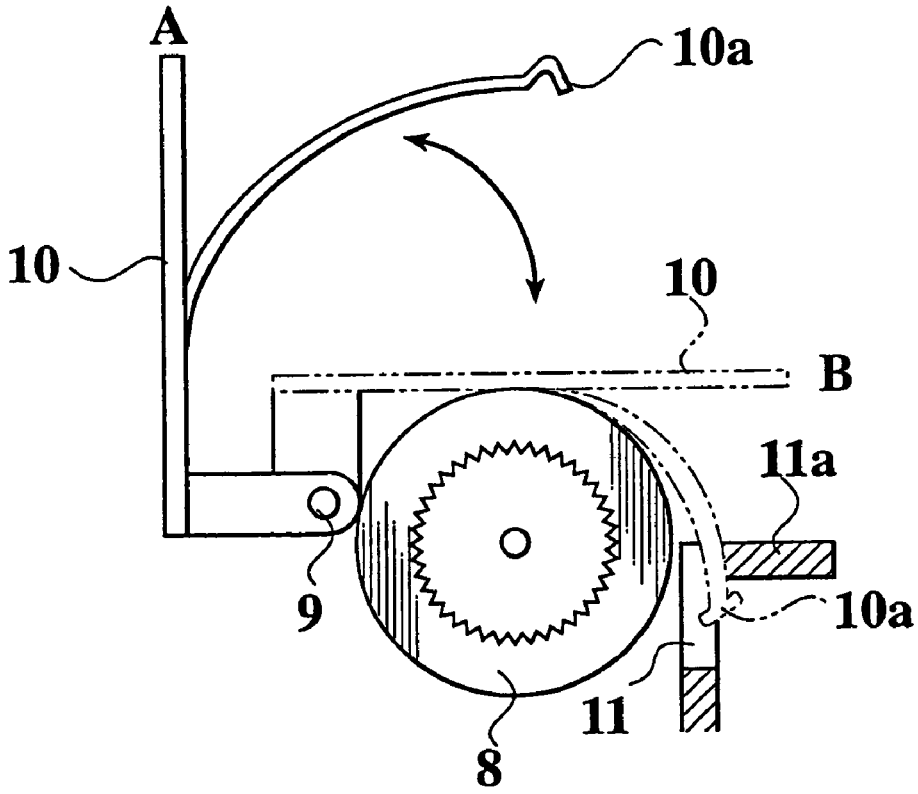
FIG. 6 is a side view showing open and close states of a motor holding plate of the vehicle toy shown in FIG. 1.

Further, a motor holding plate 10 is provided on the rear portion of the chassis 2 as shown in FIGS. 2 to 4. The motor holding plate 10 is not limited to the following structure. The motor holding plate 10 is formed out of copper or the like. A plurality of slits or holes is suitably provided in order to satisfy both the improvement on the radiation of the motor 8 and the effect of holding the motor 8. The motor holding plate 10 is constructed so as to be rotatable around the transversal shaft 9 extending in a transverse direction on the front side of the motor containing part 7. The motor holding plate 10 is constructed so as to take an open position (A shown in FIG. 6) in which the motor containing part 7 is opened, and a close position (B shown in FIG. 6) in which the motor containing part 7 is closed, by rotating it around the transversal shaft 9. The motor holding plate 10 is constructed so as to hold the body part 8*b* of the motor 8 set to the motor containing part 7 when the motor holding plate 10 is in the close position.

A middle portion of the motor holding plate 10 in a width direction, is curved. An end of the curved portion constitutes an engaging portion 10*a*. The curved portion has some elasticity. When the motor holding plate 10 is moved from the open position (A shown in FIG. 6) to the close position (B shown in FIG. 6) by rotating it around the transversal shaft 9, the curved portion is inserted into a hole portion 11 provided on a rear side of the motor containing part 7 of the chassis 2. The engaging portion 10*a* is engageable with an edge (engaging portion) 11*a* of the hole portion 11 by using the elasticity of the motor holding plate 10.

Figure 7:
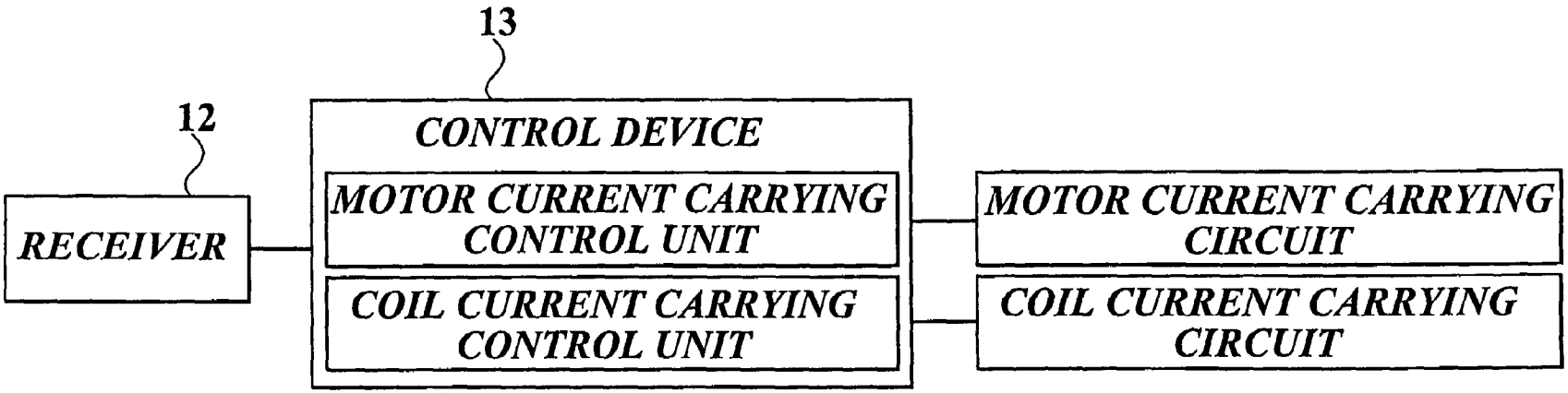
FIG. 7 is a block diagram showing an example of an internal circuit of the vehicle toy shown in FIG. 1.

FIG. 7 is a block diagram showing an internal circuit of the vehicle toy 1. The vehicle toy 1 comprises a receiver 12 for receiving a control signal outputted from a remote controller (which is not shown in the figure) via an antenna (which is not shown in the figure), and a control device 13 for controlling the current to be carried to the motor 8 and the coil 14, of the vehicle toy 1, in accordance with the control signal received by the receiver 12. The control device 13 is arranged on a printed wiring board which is not shown in the figure. The printed wiring board is disposed above the battery 4.

Figure 8:
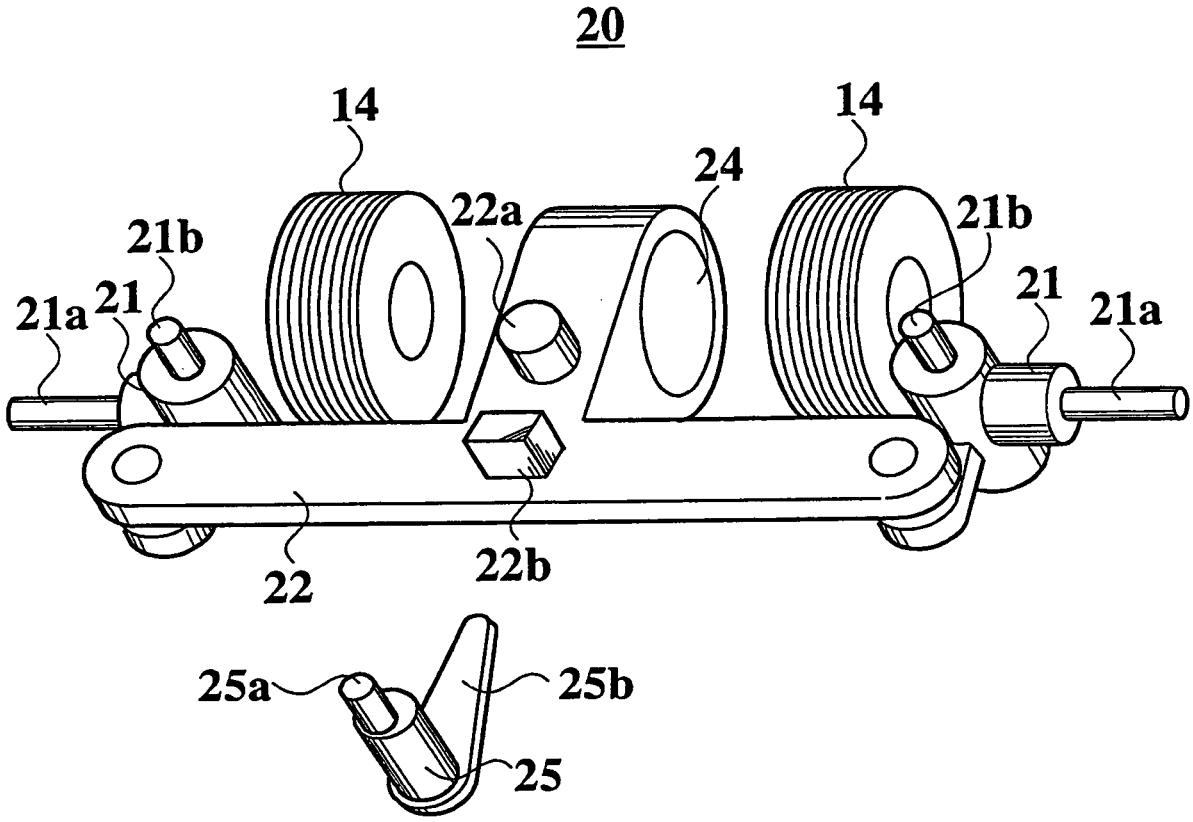
FIG. 8 is a perspective view showing an embodiment of a steering device according to the present invention, which is provided in the vehicle toy shown in FIG. 1.

Next, a steering device of the vehicle toy 1 will be explained in detail. As shown in FIG. 8, the steering device 20 of the vehicle toy 1 comprises right and left knuckle arms (turning members) 21 and 21 on which right and left front wheel shafts 21*a* and 21*a* are provided, respectively, and a tie rod (connecting member) 22 for connecting the right and left knuckle arms 21 and 21 with each other.

Figure 9:
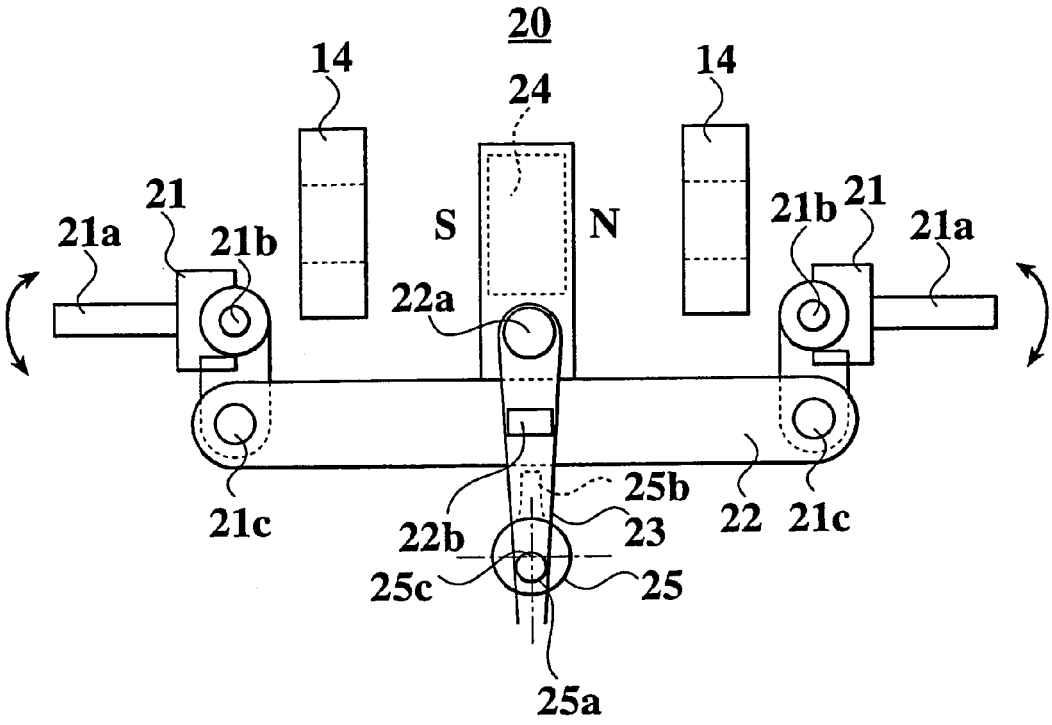
FIG. 9 is a plan view showing the steering device.
Figure 11:
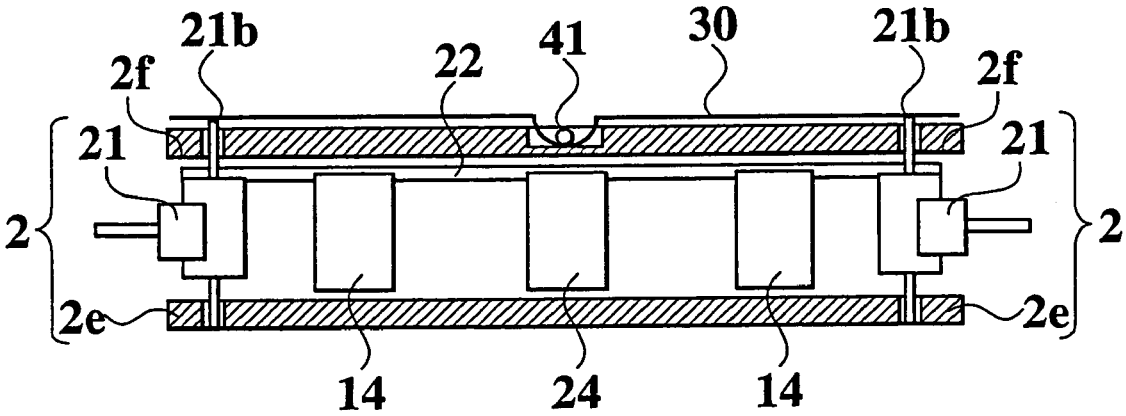
FIG. 11 is a vertical sectional view from the front side, which shows an embodiment of a suspension provided in the vehicle toy shown in FIG. 1.

The front wheel shaft 21*a* is provided on each knuckle arm 21. The front wheel 2*c* is attached to the front wheel shaft 21*a* so as to be able to rotate. As shown in FIG. 9, the right and left knuckle arms 21 and 21 are supported by the chassis 2 so as to be turnable around each of right and left shafts 21*a* and 21*a*. An upper edge portion and a lower edge portion, of each of the right and left shafts 21*a* and 21*a* are inserted into a hole portion of an upper chassis 2*f* and that of a lower chassis 2*e* respectively, as shown in FIG. 11. The hole portion into which the upper edge portion of each shaft 21*b* and 21*b* is inserted, penetrates through the upper chassis 2*f* vertically. The right and left knuckle arms 21 are slightly movable vertically between the lower chassis 2*e* and the upper chassis 2*f*. On the other hand, the tie rod 22 constructs turning pairs with the free end portions of the knuckle arms 21 at the positions of the shafts 21*c* provided on both edge portions of the tie rod 22. As a result, when the tie rod 22 moves in right and left directions, each of the right and left knuckle arms 21 is turned around the shaft 21*b*, and the directions of the right and left front wheels 2*c* are changed.

A torsion spring 23 is provided on the tie rod 22. A spiral portion of a head part of the torsion spring 23 is set on a projection 22*a* provided on the tie rod 22. Two side legs of the torsion spring 23 sandwich the projection 22*b* provided on the tie rod 22. An end portion of the torsion spring 23 is received by a trim 25 provided behind the tie rod 22. This end portion of the torsion spring 23 engages an eccentric cam 25*a* of the trim 25. The eccentric cam 25*a* is turned in clockwise and counterclockwise directions around the shaft line 25*c* by turning the lever 25*b* exposed under the chassis 2, in clockwise and counterclockwise directions around the shaft line 25*c*. A neutral position of the tie rod 22 can be finely adjusted by turning the eccentric cam 25*a*. The torsion coil spring 23 keeps the tie rod 22 in a position (neutral position) which is not biased in either right or left directions.

A permanent magnet 24 is disposed on a front side of the tie rod 22. The permanent magnet 24 is formed in a disk shape, and is disposed so as to direct both side surfaces (both pole faces) thereof to right and left directions. One side surface of the permanent magnet 24 is an S pole. The other side surface is an N pole. Two coils 14 and 14 are provided in front of the tie rod 22 on the right and left sides. The coil 14 can be a round air core coil in which a core does not exist. One end portion of each coil 14 faces to the side surface of the permanent magnet 24 disposed on the tie rod 22. Needless to say, a coil having a core can be also used as a coil 14. The reason a disk-shaped permanent magnet and a round air core coil are preferably used is that the whole toy is downsized and lightened by not inserting a core into a coil. In case of the round air core coil, a magnetic force to be generated by the coil is weak. However, this problem is solved by using the torsion spring coil 23 having a slight biasing force.

Figure 10:
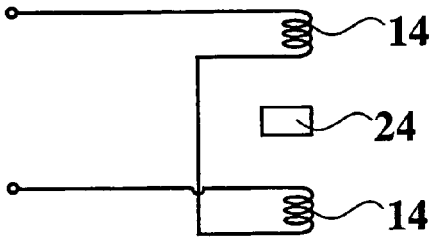
FIG. 10 is a view showing a part of the coil current carrying circuit of the vehicle toy shown in FIG. 1.

FIG. 10 shows a part of the coil current carrying circuit. A current carrying operation of the coil current carrying circuit is controlled by the coil current carrying control unit. The coil current carrying circuit is constructed so as to carry the current to the right and left coils 14 and 14 simultaneously. The coil current carrying circuit is constructed so that each side of the coils 14 and 14, which faces both side surfaces of the permanent magnet 24 becomes the same pole (N pole or S pole) when the current is carried to the right and left coils 14 and 14 simultaneously. Therefore, when the current is carried to the right and left coils 14 and 14, an attractive force is generated between one coil 14 and the permanent magnet 24 and a repulsive force is generated between the other coil 14 and the permanent magnet 24. As a result, the tie rod 22 is moved against the biasing force of the torsion coil spring 23. In this case, in order to change the moving direction of the tie rod 22, the direction of the current to be carried to the coils 14 and 14 may be changed by the coil current carrying control unit.

Alternatively, the coil current carrying circuit may be constructed so that the current is selectively carried to one of the right and left coils 14 and 14. Then, the tie rod 22 may be moved by an attractive force or a repulsive force, which is generated between the coil 14 to which the current is carried, and the permanent magnet 24.

FIG. 11 shows an embodiment of a suspension for the vehicle toy according to the present invention. The suspension 40 comprises a leaf spring 30. The leaf spring 30 is disposed on the upper chassis 2*f*. A middle portion of the leaf spring 30 is curved in a U-shape. The curved portion is lightly held by a shaft 41 provided on the upper chassis 2*f*. On the other hand, the right and left edge portions of the leaf spring 30 are arranged on hole portions for inserting each upper edge portion of the shafts 21*b* and 21*b* therein and are in contact with the shafts 21*b* and 21*b* so as to press each upper edge of the shafts 21*b* and 21*b*. Thereby, the leaf spring 30 has a function of absorbing a shock from a road surface, which is caused in accordance with bumps of a running surface for the front wheels 2 of the vehicle toy 1.

Figure 12A:
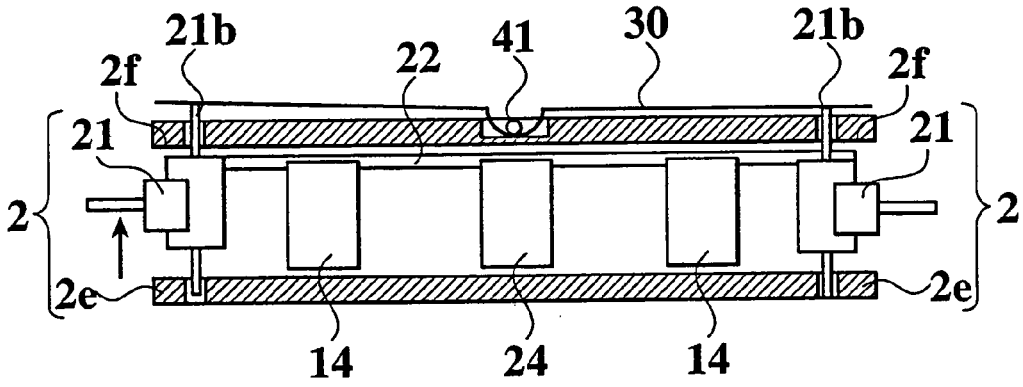
FIGS. 12A and 12B are vertical sectional views showing each operating state of the suspension shown in FIG. 11.
Figure 12B:
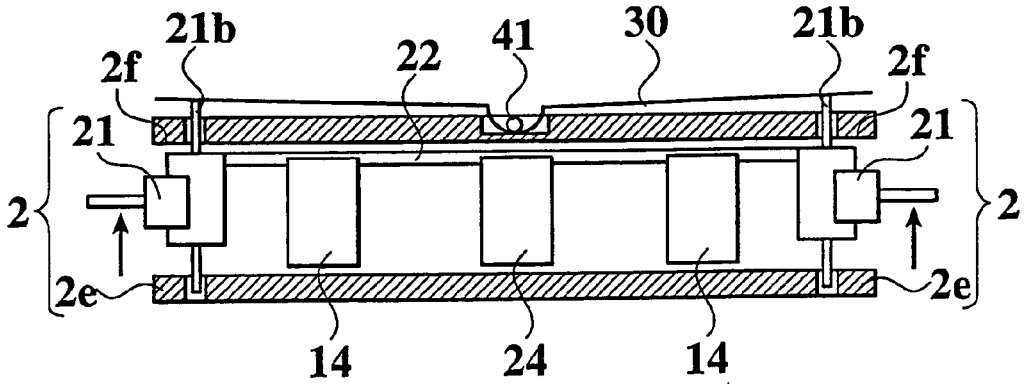

FIGS. 12A and 12B show different operating states of the suspension shown in FIG. 11 from each other. As shown in FIG. 12A, when one side front wheel 2*c* is moved up in a direction of an arrow, one side portion of the leaf spring 30 (portion from the shaft 41 to the above-described front wheel 2*c*) is bent. As shown in FIG. 12B, when both side front wheels 2*c* and 2*c* are moved up, both side portions of the leaf spring 30, which are extended from the shaft 41, are bent. Thereby, the leaf spring 30 can absorb a shock from a road surface, which is caused in accordance with bumps of a running surface for the front wheels 2 of the vehicle toy 1. Further, the wheels can be properly contacted with a running surface.

Needless to say, the structure of the suspension is effective, even though the suspension is not combined with the steering device.

As described above, the embodiment of the present invention is explained. However, the present invention is not limited to the above embodiment. Needless to say, any modification may be adopted without departing from the gist thereof.

For example, although a permanent magnet is provided on the tie rod and two coils are provided on both sides of the permanent magnet in this embodiment, a coil may be provided on the tie rod and two permanent magnets may be provided on both sides of the coil. In essence, the steering device has a structure that the tie rod is moved in right and left directions by an electromagnetic force generated between a coil and a permanent magnet.

Although a permanent magnet is provided as a magnetic body in the embodiment, a magnetic body which is not magnetized may be provided instead of a permanent magnet.

As described above, in accordance with a steering device for toy according to the present invention, because a tie rod takes at least two steering positions by controlling the current to be carried to the coil with the coil current carrying control unit, the structure thereof can be simple. Further, it is possible to suitably run a toy along a curved line.

In accordance with a running toy according to the present invention, it is possible to steer rapidly. Further, it is possible to enjoy racing on a course having curves, such as a circuit or the like.

The entire disclosure of Japanese Patent Application No. Tokugan 2000-361533 filed on Nov. 28, 2000 including specification, claims drawings and summary are incorporated herein by reference in its entirety.

What is claimed is:

1. A steering device for a toy, comprising:

right and left turning members, each receiving a wheel;

a tie rod to connect the right and left turning members with each other;

a coil and a magnetic body to move the tie rod between first and second positions by carrying a current to the coil, wherein one of the coil and the magnetic body is provided on the tie rod, the other of the coil and the magnetic body is fixed on the toy, and the connecting member is moved when one of the coil and the magnetic body moves coaxially relative to the other to come close to and go away from each other, and wherein the right and left turning members are turned by moving the tie rod so as to change a direction of the wheels.

2. The steering device for a toy as claimed in claim 1, wherein the magnetic body is provided on the tie rod, and the coil is fixed on the toy.

3. The steering device for a toy as claimed in claim 2, wherein the permanent magnet is provided so as to direct two poles of the permanent magnet to right and left directions, and the coil is provided so as to face an edge portion of the coil to one of the two poles of the permanent magnet.

4. The steering device for a toy as claimed in claim 1, wherein the tie rod centrally receives a spring for urging the connecting member into a neutral position between the first and second positions, when the current is not carried to the coil.

5. The steering device as claimed in claim 1 further comprising:

a trim to hold the connecting member in a neutral position between the first and second positions by adjusting a position of the torsion spring, wherein the trim includes an eccentric cam to receive an end of the torsion spring, and a lever to adjust the position of the eccentric cam.

6. The steering device for a toy as claimed in claim 4, further comprising a turnable device at the tie rod for adjusting the position of the spring.

7. The steering device as claimed in claim 1, wherein the magnetic body includes a permanent magnet or a material which is magnetized in a magnetic field.

8. The steering device as claimed in claim 1, wherein the tie rod is moved by both an attractive force and a repulsive force which are generated between the pair of coils and the magnetic body.

9. The steering device as claimed in claim 1, wherein the tie rod is movable between a left steering position, through a neutral position, and a right steering position.

10. The steering device as claimed in claim 1, wherein the tie rod takes the neutral position when the current is not carried to the coil.

11. The steering device as claimed in claim 1, wherein the tie rod takes the left and right positions, respectively, corresponding to a direction of the current being carried to the coil.

12. The steering device as claimed in claim 1, wherein the coil is round.

13. The steering device as claimed in claim 1, wherein the coil has a solid or air core.

14. The steering device as claimed in claim 1, wherein the magnetic body is a disc shape.

15. A steering device for a toy, comprising:

right and left turning members to turn respective wheels;

a connecting member to connect the right and left turning members with each other;

an electromagnetic force applying member to apply an electromagnetic force to move the connecting member between a first position and a second position to turn the wheels;

a current carrying control unit to control an operation of the electromagnetic force applying member, wherein the electromagnetic force applying member includes at least two components and one moves coaxially relative to another;

a torsion spring for urging the connecting member into a neutral position between the first and second positions, when the current carrying control unit does not control the operation of the electromagnetic force applying member; and a trim for adjusting the neutral position of the connecting member by adjusting a position of the torsion spring, wherein the trim comprises an eccentric cam abutting the spring, and a lever connected to the cam for rotating the cam.

16. The steering device as claimed in claim 15, further comprising a suspension having a biasing member which contacts the right and left turning members;

wherein the turning members are biased in a first direction by the right and left edge portions.

17. The steering device as claimed in claim 15, further comprising: a suspension comprising two wheel shafts extending respectively from the turning members, the suspension including a biasing member having right and left edge portions elastically deformable in upper and lower directions;

wherein the wheel shafts are movable in the upper and lower directions in a predetermined range, and the wheel shafts are pressed with the right and left edge portions by a biasing force of the biasing member so that the wheels are in contact with a ground.

18. A running toy, comprising:

a steering device for a toy, comprising:

first and second turning members to turn respective steering wheels;

a connecting member to connect the turning members with each other;

a coil and a magnetic body to move the connecting member between first and second positions by carrying a current to the coil; and a torsion spring to keep the connecting member at a neutral position between the first and second positions, when the current is not carried in the coil, wherein the turning members are turned by moving the connecting member between the first and second positions to change a direction of the steering wheels, wherein one of the coil and the magnetic body is provided on the connecting member, and the other of the coil and the magnetic body is fixed to the toy, wherein the connecting member is moved when the coil and the magnetic body come close to and go away from each other coaxially by controlling a current to be carried to the coil with a coil current carrying control unit; and a device for adjusting a position of the spring into the neutral position.

19. The running toy as claimed in claim 18, wherein the device for adjusting the position of the spring includes an eccentric cam to receive a first end of the torsion spring, and a lever to adjust the position of the eccentric cam.

20. The running toy as claimed in claim 18, wherein the toy is remotely controlled.

21. The running toy as claimed in claim 18, wherein the coil is round.

22. The running toy as claimed in claim 18, wherein the coil has a solid or air core.

23. A running toy, comprising:

a steering device including first and second turning members;

a connecting member to connect the turning members with each other;

an electromagnetic force applying member to apply an electromagnetic force to move the connecting member;

a current carrying control unit to control a current carried to the electromagnetic force applying member, so that the connecting member is movable between two steering positions, wherein the electromagnetic force applying member includes at least two components and one moves coaxially relative to another;

a torsion spring for urging the connecting member into a neutral position between the two steering positions, when the current is not carried to the electromagnetic force applying member;

a suspension device to bias the turning members; and a device for adjusting a position of the spring.

24. The running toy as claimed in claim 23, wherein the toy is remotely controlled.

25. A steering device for a toy, comprising:

right and left turning members to turn right and left steering wheels rotatably mounted thereon;

a connecting member to connect the right and left turning members, an air core coil and a magnetic body, one of the air core coil and the magnetic body being located on the connecting member and the other being fixed on the toy, to use coil current to move the connecting member between at least two steering positions as the coil and magnetic body move coaxially towards/away from each other; and a torsion spring for urging the connecting member into a neutral position between the at least two steering positions, when no coil current is applied.

26. The steering device for a toy as claimed in claim 25, further comprising a turnable device for adjusting the position of the spring.

27. A steering device for a toy, comprising:

right and left turning members to turn right and left steering wheels respectively;

a tie rod to connect the right and left turning members together;

a coil fixed to a chassis of the toy to apply, upon receiving current, an electromagnetic force to move the tie rod in right and left directions, to turn the right and left steering wheels;

a magnetic body located on the tie rod to move coaxially with and attract/repel the coil;

a control unit to control current to the coil to cause the tie rod to move; and a torsion spring for urging the tie rod into a neutral position, when the coil current is halted.

28. The steering device for a toy as claimed in claim 27, further comprising a turnable device for adjusting the position of the spring.

29. A running toy comprising:

a steering device for the toy, including right and left turning units to turn right and left steering wheels, respectively;

a tying member, to tie and move the right and left turning units into at least two steering positions;

an air core coil stationary on the toy and a magnetic body movable with the tying member, which coil and body move the tying member in right and left directions when a current is applied to the air core coil, thereby coaxially moving the air core coil toward/away from the magnetic body; and a torsion spring for urging the tying member into a neutral position between the at least two steering positions, when the current is halted.

30. The steering device for a toy as claimed in claim 29, further comprising a turnable device for adjusting the position of the spring.

31. The running toy as claimed in claim 29, wherein the toy is remotely controlled.

32. A running toy, comprising:

a steering device including right and left turning units to turn right and left steering wheels, respectively;

a tie rod to connect and move the right and left turning units into at least two steering positions;

a coil on the tie rod to apply an electromagnetic force to move the tie rod in left and right directions to turn the right and left steering wheels;

a pair of spaced permanent magnets fixed on the toy to attract/repel the coil moving coaxially therebetween due to the electromagnetic force;

a control unit to control a current to the coil;

a spring for urging the tie rod into a neutral position between the at least two steering positions when the current is halted; and a suspension device to urge the right and left turning units, which are movable in first and second opposite directions in a predetermined range, in a direction perpendicular to the right and left directions.

33. The running toy as claimed in claim 32, further comprising a turnable device for adjusting the position of the spring.

34. The running toy as claimed in claim 32, wherein the toy is remotely controlled.

35. The running toy as claimed in claim 32, wherein the coil is round.

36. The running toy as claimed in claim 32, wherein the coil has a solid or air core.

37. A running toy, comprising:

a steering device including right and left turning units to turn right and left steering wheels, respectively;

a tie rod to connect and move the right and left turning units into at least two steering positions;

a pair of spaced coils fixed to the toy to apply an electromagnetic force to move the tie rod in right and left directions to turn the right and left steering wheels;

a permanent magnetic on the tie rod, coaxially between the pair of coils, to attract/repel the coils due to the electromagnetic force;

a control unit to control a current to the coils;

a spring for urging the tie rod into a neutral position between the at least two steering positions when the current is halted; and a suspension device to urge the right and left turning units, which are movable in first and second opposite directions in a predetermined range, in a direction perpendicular to the right and left directions.

38. The running toy as claimed in claim 37, further comprising a turnable device for adjusting the position of the spring.

39. The running toy as claimed in claim 37, wherein the toy is remotely controlled.

40. The running toy as claimed in claim 37, wherein a side surface of each coil faces the magnetic body and becomes the same pole when the current is carried to the right and left coils, generating an attractive force between one of the coils and the magnetic body, and a repulsive force between the other of the coils and the magnetic body.

41. The running toy as claimed in claim 37, wherein the current is selectively carried to one of the coils, and the tie rod is moved by the electromagnetic force generated between the coil to which the current is carried, and the magnetic body.

* * * * *

UNITED STATES PATENT AND TRADEMARK OFFICE

CERTIFICATE OF CORRECTION

PATENT NO. : 6,997,774 B2
APPLICATION NO. : 10/806216
DATED : February 14, 2006
INVENTOR(S) : Yoshinobu Kaneko et al.

It is certified that error appears in the above-identified patent and that said Letters Patent is hereby corrected as shown below:

In column 10, line 28, delete “the” and after “portions” insert --of the biasing member--.
In column 12, line 62, after “magnetic” insert --body--.

Signed and Sealed this

Third Day of April, 2007

JON W. DUDAS
*Director of the United States Patent and Trademark Office*